US005786746A

United States Patent [19]

Lombardo et al.

[11] Patent Number: 5,786,746

[45] Date of Patent: Jul. 28, 1998

[54] CHILD CARE COMMUNICATION AND SURVEILLANCE SYSTEM

[75] Inventors: Igino Lombardo; Richard A. Slater, both of Sharon, Mass.

[73] Assignee: Allegro Supercare Centers, Inc., Norwood, Mass.

[21] Appl. No.: 538,251

[22] Filed: Oct. 3, 1995

[51] Int. Cl.[6] ..... G08B 13/02

[52] U.S. Cl. ..... 340/286.07; 340/573; 348/14

[58] Field of Search ..... 340/573, 286.01, 340/286.07, 311.1; 379/38; 348/143, 159, 12, 13, 14, 77, 156

[56] References Cited

U.S. PATENT DOCUMENTS

| | | | |
|---|---|---|---|
| 3,588,336 | 6/1971 | Scher | 348/14 |
| 3,757,039 | 9/1973 | Brewer | 348/159 |
| 3,868,478 | 2/1975 | Zeenkov | 348/159 |
| 3,946,159 | 3/1976 | Fay | 340/311.1 |
| 4,511,886 | 4/1985 | Rodriguez | 340/534 |
| 4,777,526 | 10/1988 | Saitoh et al. | 348/159 |
| 4,843,377 | 6/1989 | Fuller et al. | 340/573 |
| 4,899,135 | 2/1990 | Ghahariiran | 340/573 |
| 5,153,582 | 10/1992 | Davis | 340/311.1 |
| 5,202,759 | 4/1993 | Laycock . | |
| 5,270,811 | 12/1993 | Ishibashi et al. . | |
| 5,305,100 | 4/1994 | Choi | 348/159 |
| 5,321,396 | 6/1994 | Lamming et al. | 348/143 |
| 5,412,708 | 5/1995 | Katz | 348/14 |
| 5,448,221 | 9/1995 | Weller | 340/573 |
| 5,544,649 | 8/1996 | David et al. | 348/14 |

*Primary Examiner*—Brent A. Swarthout
*Attorney, Agent, or Firm*—Choate, Hall & Stewart

[57] ABSTRACT

A child/dependent care system provides a way for parents (or other responsible individuals) to remotely observe and communicate with their children (or dependents or other charges) at a care center. The system includes a video link between the care center, or "activity area," and one or more remote areas disposed remotely from the care center. Each video link includes a video camera and monitor, permitting the parent to see his or her charge at the care center, and vice versa. The system can also include a telephone link between the sites, permitting voice communication between the parent and the charge. Still further, the system can provide a paging link, whereby an adult supervisor at the center can page the parent and alert him or her to contact the center e.g., via phone. A lock-out can also be provided to insure that only authorized parents can view charges at the care center.

10 Claims, 1 Drawing Sheet

CHILD CARE COMMUNICATION AND SURVEILLANCE SYSTEM

BACKGROUND OF THE INVENTION

This invention pertains to child and dependent care systems and, more particularly, systems permitting remote surveillance of and communication with children and dependents at a care center. The invention has application, for example, in shopping malls, where it permits parents to remotely observe and communicate with their children at a child care center.

Traditionally, once a child is left to the care of a day care center, the parent has no way to inconspicuously monitor the child's play and behavior from remote locations. Nor does the parent have a way to remotely see and speak with the child, and vice versa. This is a source of concern for both the parent and the child. The situation is further aggravated when the parent uses a new child care center, or uses a known child care center on only an occasional basis.

Parents often bring their children to shopping malls and, sometimes, wish to leave them in the care of a reliable child care center while the parent shops. Since shopping is done on an occasional basis, and the parent typically shops in many different malls, it is likely that neither the parent nor the child will be comfortable parting for this purpose. The parent will, most likely, be concerned about leaving the child with "strangers," and the child may find objection in being left in a strange place.

The above concerns arise not only between parent and child, but between any individual and his or her dependent or charge.

In view of the foregoing, an object of the invention is to provide improved child and dependent care systems.

More particularly, an object of the invention is to provide such systems as permit a parent, or other responsible party, to observe and to communicate with his or her charge at a care center.

A further object of the invention is to provide such systems as can be readily and inexpensively installed in existing commercial establishments, such as shopping malls, or in geographically dispersed areas.

Still another object is to provide such systems as permit only authorized parents and other individuals to observe and communicate with the charges at the care center.

SUMMARY OF THE INVENTION

The foregoing and other objects are attained by the invention which provides, in one aspect, a way for parents (or other responsible individuals) to remotely observe and communicate with their children (or dependents or other charges) at a care center. The system includes a video link between the care center, or "activity area," and one or more remote areas disposed remotely from the care center. Each video link includes a video camera and monitor, permitting the parent to see his or her charge at the care center, and vice versa. The system can also include a telephone link between the sites, permitting voice communication between the parent and the charge. Still further, the system can provide a paging link, whereby an adult supervisor at the center can page the parent and alert him or her to contact the center e.g., via phone. A lock-out can also be provided to insure that only authorized parents can view charges at the care center.

In other aspects, the invention provides a child care system for use e.g., by patrons of a shopping mall. The system includes an activity area, located in the child care center, where one or more children can recreate. It also includes a remote communicate/surveillance area, located elsewhere, e.g., in the mall and remote from the child care center. A first video camera is disposed in the child care center for generating an image of at least a portion of the activity area. A first video monitor, also disposed in the child care center, selectively displays at least a portion of an image of the remote area. A second video camera is disposed at the remote area and is coupled to the first video monitor. That second camera generates an image of at least a portion of the remote area. A second video monitor is disposed at the remote area and coupled to the first video camera. It selectively displays at least a portion of the image of the activity area.

According to other aspects of the invention, there are provided multiple remote communication/surveillance areas disposed about the mall at sites remote from the child care center. The video monitor disposed in the child care center selectively displays at least a portion of an image from at least one of those remote areas.

Child care systems of the type described above, according to further aspects of the invention, can include voice communication elements, e.g., telephones, at the child care center and the remote area for providing voice communications there between.

In still further aspects, child care systems of the type described above can provide a lock-out that prevent a video monitor at a remote area from displaying images of the activity area, absent a key or an authorizing transmission from the child care center. This key can be a password that is entered by the parent at a keypad disposed adjacent to the remote area, or a passcard inserted in a receiving slot at the area. The authorizing transmission can be, for example, generated by a supervisor at the child care center in response to the parent's phone call.

In still further aspects, the invention provides child care systems of the type described above that further include a pager that can be carried about by the parent and activated in response to an alert call generated at the child care center.

Still further aspects of the invention provide child and dependent care systems constructed and operated similarly to the child care systems described above. These and other aspects of the invention are evident in the drawings and in the description that follows.

BRIEF DESCRIPTION OF THE DRAWINGS

A more complete understanding of the invention may be attained by reference to the attached drawings, in which.

DETAILED DESCRIPTION OF THE ILLUSTRATED EMBODIMENT

Figure 1:
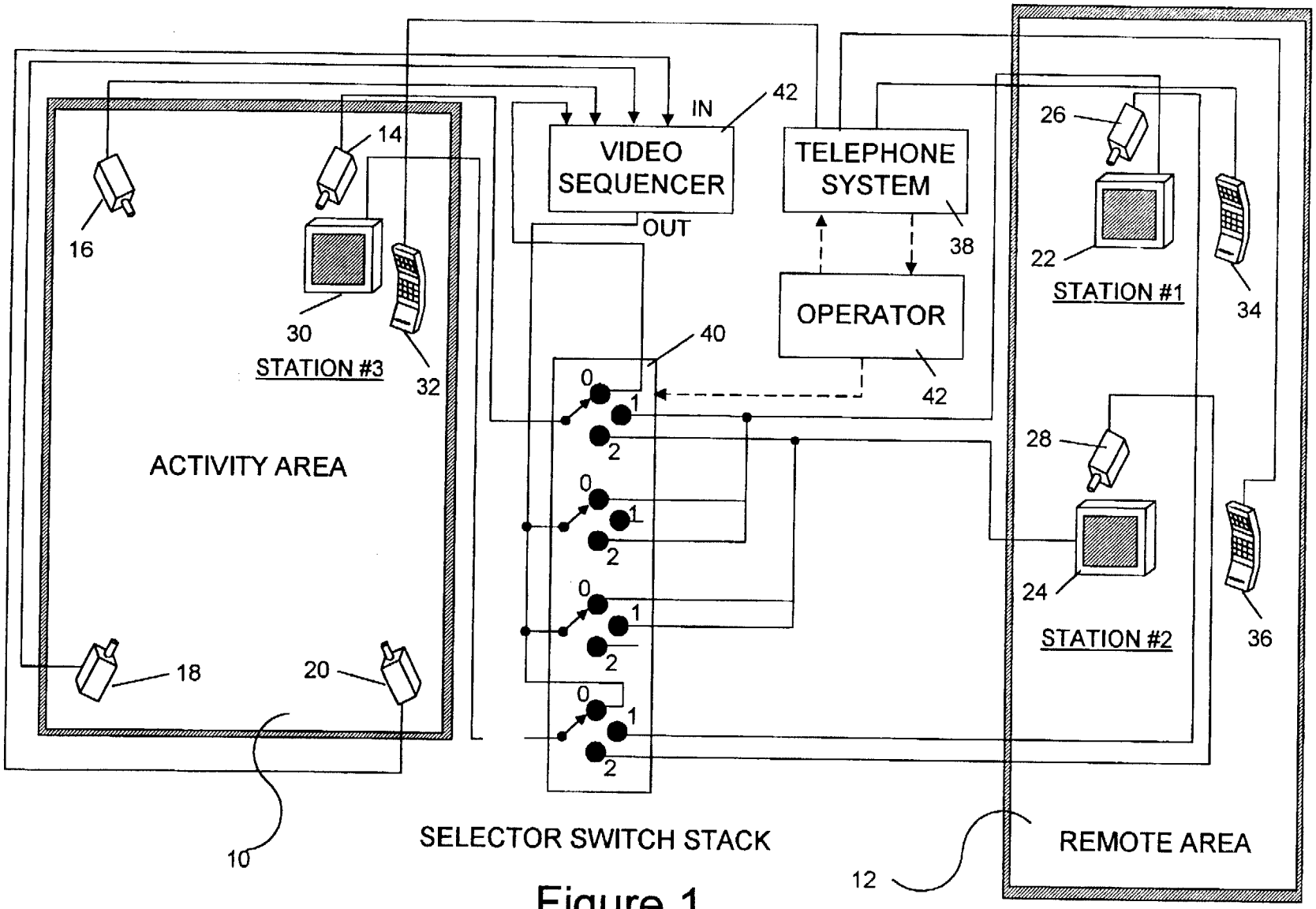
FIG. 1 depicts a child care communication and surveillance system according to the invention.

FIG. 1 depicts a child care communication and surveillance system according to the invention, including an activity area 10 and a remote area 12. The activity area 10 is where children, or other charges to be observed, recreate or otherwise reside. It can be, for example, part of a child or dependent care center. The remote area 12 is situated remotely from the activity area 10 and is where the parent, or other responsible party, can observe and, optionally, communicate with his or her charge. The remote area can be a kiosk, a room or other area that can accommodate a video monitor and video camera, as discussed below. The remote area 12 can be disposed in a commercial establishment, e.g., a shopping mall, of which the activity area 10 is also a part. Alternatively, the remote area 12 can be disposed in a geographic area, e.g., a "downtown" shopping area, in which the activity area 10 also resides.

The activity area 10 has disposed therein video cameras 14–20, each situated for generating an image of at least a portion of the activity area and, preferably, of the charges therein. The video cameras 14–20 are conventional, commercially available such cameras. Other apparatus capable of generating images of the activity area 10 may be used as well.

Though the discussion below assumes the existence of only one remote area 12, it will be appreciated that additional remote areas—preferably dispersed apart from one another—can be used as well.

Video monitors 22 and 24 are disposed at remote area 12 to permit viewing of the children at the activity area 10. Together with video cameras 14–20, video monitors 22–24 form a surveillance system whereby a parent at the remote area can watch a child in the activity area 10. Video monitors 22–24 are of a conventional, commercially available variety capable of displaying images generated by video cameras 14–20.

The remote area 12 further includes video cameras 26, 28 that generate images of the remote area and, more particularly, of parents who are using that area 12. Those video cameras 26–28 are also of conventional, commercially available variety. Images generated by the cameras 26–28 can be viewed from the video monitor 30 in the activity area 10. That video monitor is also of conventional, commercially available variety. In the illustrated embodiment, images from cameras 26–28 can be displayed individually, or together, on the monitor. In an alternate embodiment, a single monitor (e.g., 30) can be dedicated to each remote camera 26–28.

The activity area 10 includes a telephone 32 that can be coupled to telephones 34–36 in remote area 12 to permit voice communications between the activity area and the remote area. Telephones 32–36, as well as the communications lines and telephone system 38 by which they are connected, are of a conventional, commercially available variety. Together, these provide a voice communication link between the remote area 12 and the activity area 10.

Video camera 26, video monitor 22 and telephone 34, when connected to video camera 14, video monitor 30, and telephone 32 provide a two-way video and audio communication system which links the activity area 10 to the remote area 12.

A selector switch stack 40 and video sequencer 42, along with associated cabling, interconnect remote video cameras 26–28 with the video monitor 30 at the activity area 10. The switch stack 40 and sequencer 42 likewise interconnect the activity area video cameras 14–20 with the remote video monitors 22–24. The selector switch stack 40 and video sequencer 42 are of a conventional, commercially available variety. Their operation in conjunction with the invention is described below.

With the selector switch stack 40 in position 0, as shown in FIG. 1, video cameras 14–20 are coupled to the video sequencer 42. The output of the video sequencer 42, in turn, is connected via the selector stack switch 40 to video monitors 22 and 24 in the remote area and video monitor 30 in the activity area.

The video sequencer 42 has the capability of individually and sequentially routing the signals from the video cameras so that each is sequential displayed on the video monitors at a programmable time sequence. The sequencer 42 can also combine all of the signals from the video cameras so that each of the signals is displayed on a portion of the screen of the video monitors. Thus, for example, the images generated by the four activity area cameras 14–20 can be simultaneously shown in quadrants on the remote video monitors 22–24. The sequencer 42 can also be configured to manipulate the video camera signals in other ways familiar to those skilled in the art to enhance those images or to add additional information, e.g., time of day, child care center phone number, closing time and the like.

Thus, with the selector switch stack 42 in position 0, the illustrated system is configured as a surveillance system whereby the activity area can be monitored internally through video monitor 30 and externally through video monitors 22-24.

With the selector switch stack 40 in position 1, video camera 14 in the activity area 10 is connected directly to video monitor 22 in the remote area 12, while video camera 26 in the remote area 12 is connected directly to video monitor 30 in the activity area 10. Thus, the remote area in the vicinity of video camera 26 is displayed on video monitor 30 in the activity area 10, while the activity area in the vicinity of video camera 14 is displayed on video monitor 22 in the remote area 12. This provides a two-way video link between the activity and remote areas.

An audio link between the activity area 10 and the remote area 12 is provided through the telephone system 38, either through direct dialing or through switchboard operator 42, which connects telephone 34 to telephone 32. Thus, with the selector switch stack 40 in position 1, a two-way video and audio communicational link is established between the activity area and the remote area.

While the selector switch stack 40 is in position 1, the activity area 10 imaged by video cameras 16–20, is displayed on video monitor 24 in remote area 12. Therefore, with the selector switch stack 40 in position 1, the illustrated system provides a two-way video and audio communication link between station number 1 in the remote area and 12 and 3 in the activity area 10, while at the same time providing video surveillance of the activity area 10 from station number 2 in the remote area 12.

The remote video monitors 22–24 can be equipped with lock-outs to prevent unauthorized persons from viewing activities in the activity area 10. Those lock-outs can, for example, prevent display on the video monitors 22–24 in the absence of an authorization signal generated from the activity area 10, e.g., by an adult supervisor. More preferably, however, the lock-outs permit authorized persons to use the remote video monitors 22–24 on presentation of an appropriate key. This can be, for example, a password typed on a keyboard (not shown), a physical key inserted into a lock (not shown), or any such other mechanism well-known in the art.

A system of the type described above can be further extended by inclusion of a paging link. Particularly, by equipping a parent with a conventional, commercially available pager, an adult supervisor at the child care center (and more particularly, activity area 10) can alert the parent to call the child care center over telephones 32–36. The adult supervisor, if appropriately equipped, can generate the paging signal herself or by contacting a commercial paging service, which, in turn, can signal the parent's pager.

Described above is a child care communication and surveillance system meeting the objects of the invention. It will be appreciated that the illustrated embodiment is merely an example of the invention and that other systems falling within the scope thereof may incorporate modifications thereto.

Thus, for example, it will be appreciated that the teachings herein are equally applicable to a dependent care system as to a child care system. Moreover, those teachings can be employed outside the environs of a shopping mall, for example, on a city-wide basis.

Still further, the video monitors and video cameras of the activity area and remote area can be switchably coupled by mechanisms other than the illustrated selector switch stack and video sequencer, wherein such alternate mechanisms are well-known in the art. In addition, the voice and video signals can be transferred via conventional media, including, wire, wireless, infrared, optical, fiber optic, etc.

Moreover, the voice, video and paging communications described above can be supplemented via other communication schemes, such as terminals or teletypes for the audio impaired.

In view of the foregoing, what we claim is:

1. A child care system comprising

A. an activity area located in a child care center where one or more children can recreate;

B. a remote communication/surveillance area remote from the child care center;

C. first video camera means disposed in the child care center for generating an image of at least a portion of the activity area;

D. first video monitor disposed in the child care center for selectively displaying at least a portion of an image of the remote communication/surveillance area;

E. second video camera means, disposed at the remote communication/surveillance area and coupled to the first video monitor means, for generating an image of at least a portion of the remote communication/surveillance area; and F. second video monitor, disposed at the remote communication/surveillance area and coupled to the first video camera means, for selectively displaying at least a portion of the image of the activity area, the second video monitor including lock-out means for preventing display of at least a portion of the image of the activity area in the absence of at least one of a key and an authorizing transmission from the child care center.

2. A child care system comprising

A. an activity area located in a child care center where one or more children can recreate;

B. a plurality of remote communication/surveillance areas disposed remote from the child care center;

C. first video camera means disposed in the child care center for generating an image of at least a portion of the activity area;

D. first video monitor means disposed in the child care center for selectively displaying at least a portion of an image of at least one of the remote communication/surveillance areas;

E. second video camera means, disposed at each remote communication/surveillance areas and coupled to the first video monitor means, for selectively generating images of at least portions of the respective remote communication/surveillance area; and F. second video monitor, disposed at each remote communication/surveillance area and coupled to the first video camera means, for selectively displaying at least a portion of the image of the activity area, the second video monitor including lock-out means for preventing display of at least a portion of the image of the activity area in the absence of at least one of a key and an authorizing transmission from the child care center.

3. A child care system according to any of claims 1 and 2, comprising

A. first voice communication means, disposed at the child care center, for providing voice communications with the remote communication/surveillance area; and B. second voice communication means, disposed at each remote communication/surveillance area and coupled with the first voice communication means, for providing voice communications with the child care center.

4. A child care system comprising

A. an activity area located in a child care center where one or more children can recreate;

B. a remote communication/surveillance area remote from the child care center;

C. first video camera means disposed in the child care center for generating an image of at least a portion of the activity area;

D. first video monitor disposed in the child care center for selectively displaying at least a portion of an image of the remote communication/surveillance area;

E. second video camera means, disposed at the remote communication/surveillance area and coupled to the first video monitor means, for generating an image of at least a portion of the remote communication/surveillance area; and F. second video monitor, disposed at the remote communication/surveillance area and coupled to the first video camera means, for selectively displaying at least a portion of the image of the activity area, G. paging means responsive to a received alert call for generating an alert signal, said paging means being arranged to be transported about a mall, H. means disposed at the child care center for generating such an alert call for alerting a receiving person with the paging means to at least one of (1) contact the child care center via any of a first and second voice communication means, and (2) observing a display of at least a portion of the image of the activity area from said remote area.

5. A child care system comprising

A. an activity area located in a child care center where one or more children can recreate;

B. a plurality of remote communication/surveillance areas disposed remote from the child care center;

C. first video camera means disposed in the child care center for generating an image of at least a portion of the activity area;

D. first video monitor means disposed in the child care center for selectively displaying at least a portion of an image of at least one of the remote communication/surveillance areas;

E. second video camera means, disposed at each remote communication/surveillance areas and coupled to the first video monitor means, for selectively generating images of at least portions of the respective remote communication/surveillance area; and F. second video monitor, disposed at each remote communication/surveillance area and coupled to the first video camera means, for selectively displaying at least a portion of the image of the activity area, G. paging means responsive to a received alert call for generating an alert signal, said paging means being arranged to be transported about a mall, H. means disposed at the child care center for generating such an alert call for alerting a receiving person with the paging means to at least one of (1) contact the child care center via any of a first and second voice communication means, and (2) observing a display of at least a portion of the image of the activity area from said at least one of the remote area.

6. A dependent care system comprising

A. an activity area located in a dependent care center where one or more dependents can recreate;

B. a remote communication/surveillance area remote from the dependent care center;

C. first video camera means disposed in the dependent care center for generating an image of at least a portion of the activity area;

D. first video monitor disposed in the dependent care center for selectively displaying at least a portion of an image of the remote communication/surveillance area;

E. second video camera means, disposed at the remote communication/surveillance area and coupled to the first video monitor means, for generating an image of at least a portion of the remote communication/surveillance area; and F. second video monitor, disposed at the remote communication/surveillance area and coupled to the first video camera means, for selectively displaying at least a portion of the image of the activity area, the second video monitor including lock-out means for preventing display of at least a portion of the image of the activity area in the absence of at least one of a key and an authorizing transmission from the dependent care center.

7. A dependent care system comprising

A. an activity area located in said dependent care center where one or more dependents can recreate;

B. a plurality of remote communication/surveillance areas disposed remote from the dependent care center;

C. first video camera means disposed in the dependent care center for generating an image of at least a portion of the activity area;

D. first video monitor means disposed in the dependent care center for selectively displaying at least a portion of an image of at least one of the remote communication/surveillance areas;

E. second video camera means, disposed at each remote communication/surveillance areas and coupled to the first video monitor means, for selectively generating images of at least portions of the respective remote communication/surveillance area; and F. second video monitor, disposed at each remote communication/surveillance area and coupled to the first video camera means, for selectively displaying at least a portion of the image of the activity area, the second video monitor including lock-out means for preventing display of at least a portion of the image of the activity area in the absence of at least one of a key and an authorizing transmission from the dependent care center.

8. A dependent care system according to any of claims 6 and 7, comprising

A. first voice communication means, disposed at the dependent care center, for providing voice communications with the remote communication/surveillance area; and B. second voice communication means, disposed at each remote communication/surveillance area and coupled with the first voice communication means, for providing voice communications with the dependent care center.

9. A dependent care system comprising

A. an activity area located in a dependent care center where one or more dependents can recreate;

B. a remote communication/surveillance area remote from the dependent care center;

C. first video camera means disposed in the dependent care center for generating an image of at least a portion of the activity area;

D. first video monitor disposed in the dependent care center for selectively displaying at least a portion of an image of the remote communication/surveillance area;

E. second video camera means, disposed at the remote communication/surveillance area and coupled to the first video monitor means, for generating an image of at least a portion of the remote communication/surveillance area; and F. second video monitor, disposed at the remote communication/surveillance area and coupled to the first video camera means, for selectively displaying at least a portion of the image of the activity area, G. paging means responsive to a received alert call for generating an alert signal, said paging means being arranged to be transported about a mall, H. means disposed at the dependent care center for generating such an alert call for alerting a receiving person with the paging means to at least one of (1) contact the dependent care center via any of a first and second voice communication means, and (2) observing a display of at least a portion of the image of the activity area from said remote area.

10. A dependent care system comprising

A. an activity area located in said dependent care center where one or more dependents can recreate;

B. a plurality of remote communication/surveillance areas disposed remote from the dependent care center;

C. first video camera means disposed in the dependent care center for generating an image of at least a portion of the activity area;

D. first video monitor means disposed in the dependent care center for selectively displaying at least a portion of an image of at least one of the remote communication/surveillance areas;

E. second video camera means, disposed at each remote communication/surveillance areas and coupled to the first video monitor means, for selectively generating images of at least portions of the respective remote communication/surveillance area; and F. second video monitor, disposed at each remote communication/surveillance area and coupled to the first video camera means, for selectively displaying at least a portion of the image of the activity area, G. paging means responsive to a received alert call for generating an alert signal, said paging means being arranged to be transported about a mall, H. means disposed at the dependent care center for generating such an alert call for alerting a receiving person with the paging means to at least one of (1) contact the dependent care center via any of a first and second voice communication means, and (2) observing a display of at least a portion of the image of the activity area from said at least one of the remote area.

* * * * *